US008407843B2

(12) United States Patent
Zhang

(10) Patent No.: US 8,407,843 B2
(45) Date of Patent: Apr. 2, 2013

(54) CLEAN DEVICE FOR CLEANING GOLDFINGER

(75) Inventor: Yong Zhang, Liyang (CN)

(73) Assignee: MSI Computer(Shenzhen)Co., Ltd., Logma Information Technology Industrial Park, Tangtou Village, Shiyan Town, Baoan District, Shenzhen, Guangdong Province (CN)

( * ) Notice: Subject to any disclaimer, the term of this patent is extended or adjusted under 35 U.S.C. 154(b) by 887 days.

(21) Appl. No.: 12/549,367

(22) Filed: Aug. 28, 2009

(65) Prior Publication Data

US 2010/0288315 A1 Nov. 18, 2010

(30) Foreign Application Priority Data

May 14, 2009 (TW) ..... 98208343 U

(51) Int. Cl.
*B08B 13/00* (2006.01)

(52) U.S. Cl. ..... 15/102

(58) Field of Classification Search ..... 15/77, 102; 134/902

See application file for complete search history.

(56) References Cited

U.S. PATENT DOCUMENTS 4,129,919 A * 12/1978 Fitch et al. ..... 15/302
4,250,588 A * 2/1981 Cook et al. ..... 15/77
2009/0014031 A1* 1/2009 Yeh et al. ..... 134/15

* cited by examiner

*Primary Examiner* — Laura C Guidotti
(74) *Attorney, Agent, or Firm* — Winston Hsu; Scott Margo

(57) ABSTRACT

A clean device for cleaning a goldfinger includes a positioning mechanism for transmitting a circuit board and fixing the circuit board on a predetermined position, a delivering mechanism for delivering a cleaning medium to the predetermined position, and a wiping mechanism for utilizing the cleaning medium to wipe a goldfinger of the circuit board after the positioning mechanism fixes the circuit board on the predetermined position.

19 Claims, 2 Drawing Sheets

CLEAN DEVICE FOR CLEANING GOLDFINGER

BACKGROUND OF THE INVENTION

1. Field of the Invention

The present invention relates to a clean device, and more particularly, to a clean device for cleaning goldfinger.

2. Description of the Prior Art

With electronic products of nowadays, most circuit boards of the electronic products have goldfingers for inserting into slots of the other electronic products, such as various kinds of interface cards, display cards, and network cards. The goldfinger of a circuit board is made of metal material, which is plated with nickel of high hardness and gold of high purity, or is printed with carbon ink by halftone, for protecting the goldfinger and providing good conductivity. The goldfinger is disposed on an end edge of the circuit board and electrically connected to slots of the electronic products when the circuit board is inserted into the slots of the electronic products.

The goldfinger might be short caused by oxidation easily. There are some reasons caused by the oxidation. For example, thickness of the metal material plated on the goldfinger is not enough or quality of the metal material is bad. The metal material of the goldfinger is eroded naturally due to differences of temperature, humidity, and so on. The metal material of the goldfinger contacts oil and acidity so that the oxidation reacts rapidly. Conventional method of cleaning the goldfinger is wiped artificially, which has poor efficiency and is hard to control wiping force. And oil sludge stays on the goldfinger easily. Therefore, quality of the cleaned goldfinger by conventional method is unstable so that function of the electronic product is affected obviously.

SUMMARY OF THE INVENTION

According to the claimed invention, a clean device includes a positioning mechanism for conveying a circuit board and for positioning the circuit board on a predetermined position, a delivering mechanism for delivering a cleaning medium to the predetermined position, and a wiping mechanism for wiping a goldfinger of the circuit board by utilizing the cleaning medium after the positioning mechanism positions the circuit board on the predetermined position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
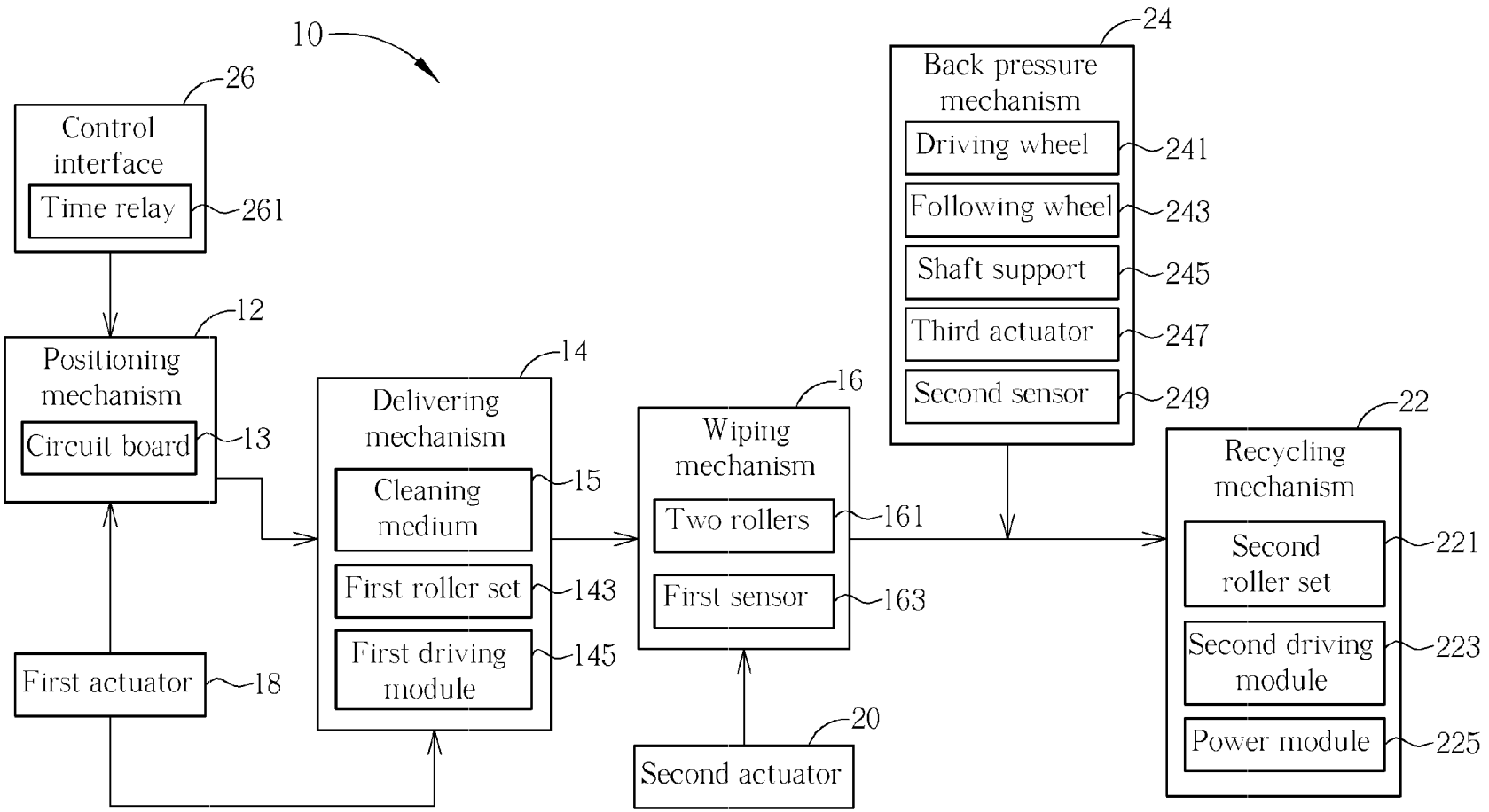
FIG. 1 is a functional block diagram of a clean device according to a preferred embodiment of the present invention.
Figure 2:
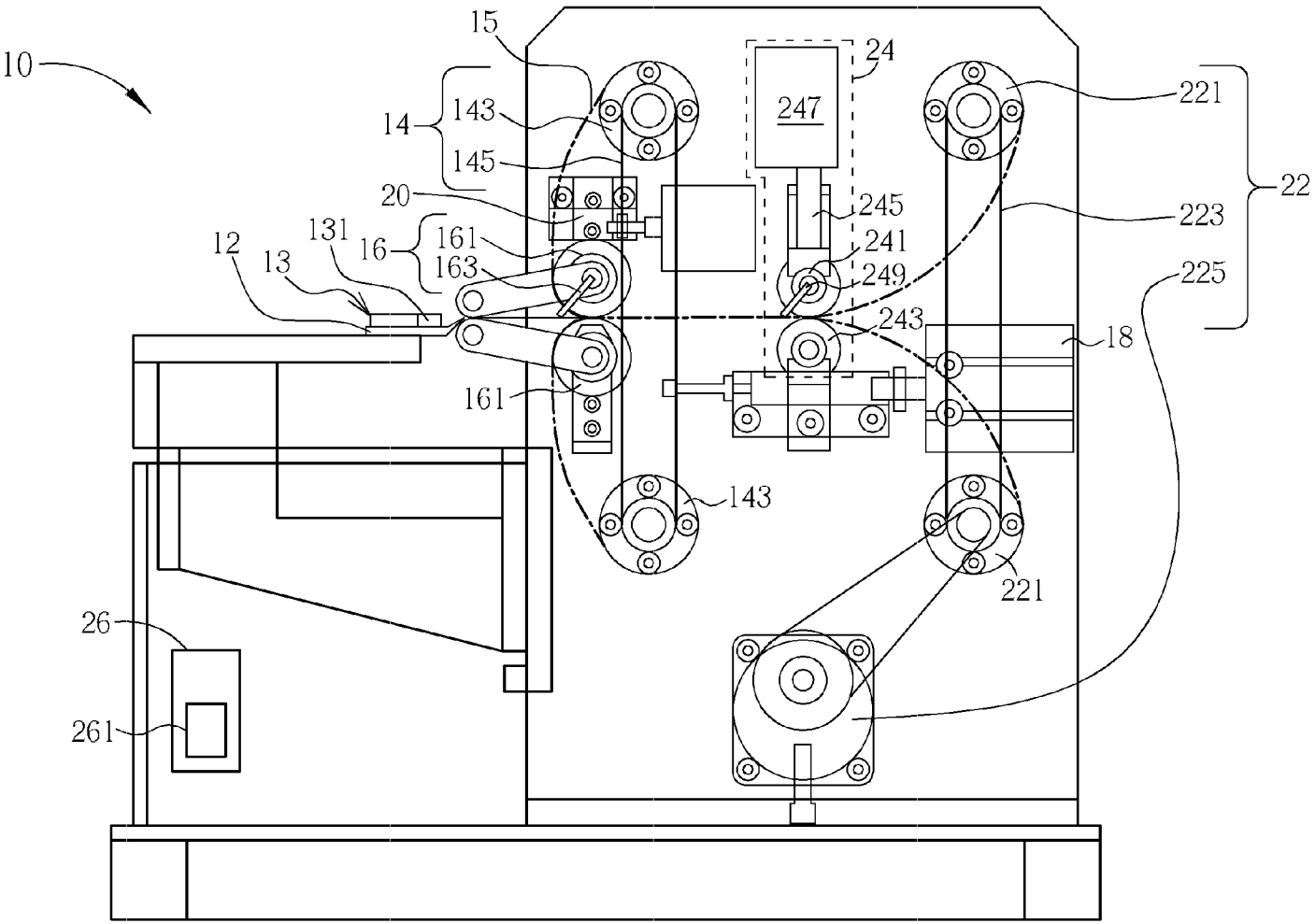
FIG. 2 is a diagram of the clean device according to the preferred embodiment of the present invention.

Please refer to FIG. 1 and FIG. 2. FIG. 1 is a functional block diagram of a clean device 10 according to a preferred embodiment of the present invention. FIG. 2 is a diagram of the clean device 10 according to the preferred embodiment of the present invention. The clean device 10 includes a positioning mechanism 12 for conveying and positioning a circuit board 13 on a predetermined position, a delivering mechanism 14 for delivering a cleaning medium 15 to the predetermined position, and a wiping mechanism 16 for wiping a goldfinger 131 of the circuit board 13 by utilizing the cleaning medium 15 after the positioning mechanism 12 positions the circuit board 13 on the predetermined position. The wiping mechanism 16 includes two rollers 161 for receiving the cleaning medium 15 delivered from the delivering mechanism 14 and for clamping the cleaning medium 15 to clean the goldfinger 131 of the circuit board 13. The cleaning medium 15 covers on peripheral surfaces of the two rollers 161. When the two rollers 161 rotates, the goldfinger 131 of the circuit board 13 clamped by the two rollers 161 can be wiped by the cleaning medium 16. Each of the two rollers 161 can be made of silica gel, plastic, or metal material, and positions and numbers are not limited to this embodiment and depend on actual demands. The circuit board 13 can be a main board or an interface card, such as a display card, a network card, and so on. The cleaning medium 15 can be made of cloth, such as a dust-free cloth, and so on.

In addition, the wiping mechanism 16 further includes a first sensor 163 disposed between the two rollers 161 for sensing a position of the circuit board 13. The delivering mechanism 14 includes a first roller set 143 for storing the cleaning medium 15, and a first driving module 145 connected to the first roller set 143 for driving the first roller set 143 so as to output the cleaning medium 15. The first roller set 143 is driven by the first driving module 145 so as to output the cleaning medium 15 to the two rollers 161 of the wiping mechanism 16 continuously. When the first sensor 163 senses that the circuit board 13 is positioned on the predetermined position, the first sensor 163 can send a signal to the delivering mechanism 14 so as to drive the first roller set 143 to convey the cleaning medium 15. Then, the first sensor 163 can further send another signal to the wiping mechanism 16 for driving the two rollers 161 so as to wipe the goldfinger 131 of the circuit board 13. Control mechanism of the delivering mechanism 14, the wiping mechanism 16, and the first sensor 163 can utilize sequence control method by a programmable logic controller (PLC). The first roller set 143 can be made of silica gel, plastic, or metal material. The first driving module 145 can be a belt.

Furthermore, the clean device 10 further includes a first actuator 18 for driving the positioning mechanism 12 and the delivering mechanism 14, and a second actuator 20 for driving the wiping mechanism 16. The first actuator 18 and the second actuator 20 can be air cylinders, respectively.

Moreover, the clean device 10 further includes a recycling mechanism 22 for receiving the cleaning medium 15 conveyed from the wiping mechanism 16. The recycling mechanism 22 includes a second roller set 221 for receiving the cleaning medium 15 conveyed from the wiping mechanism 16, a second driving module 223 connected to the second roller set 221 for driving the second roller set 221, and a power module 225 for driving the second driving module 223 to rotate the second roller set 221 and to receive the cleaning medium 15 conveyed from the wiping mechanism 16. The second roller set 221 can be made of silica gel, plastic, or metal material. The second driving module 223 can be a belt. The power module 225 can be a motor.

Besides, the clean device 10 further includes a back pressure mechanism 24 disposed between the wiping mechanism 16 and the recycling mechanism 22. The back pressure mechanism 24 includes a driving wheel 241, a following wheel 243 for clamping the cleaning medium 15 with the driving wheel 241, a shaft support 245 connected to the driving wheel 241, and a third actuator 247 connected to the shaft support 245 for driving the shaft support 245. The shaft support 245 can be used for pressing the driving wheel 241, so that the driving wheel 241 and the following wheel 243 can clamp the cleaning medium 15 together so as to keep a single delivering direction of the cleaning medium 15 delivered from the delivering mechanism 14 to the recycling mechanism 22. The third actuator 247 can be used for driving the shaft support 245, which is not only for pressing the driving wheel 241 so that the driving wheel 241 and the following wheel 243 can clamp the cleaning medium 15 together, but also is for driving the driving wheel 241 to keep the single delivering direction of the cleaning medium 15 and to prevent the cleaning medium 15 from moving backward. The back pressure mechanism 24 further includes a second sensor 249 for sensing a status of the cleaning medium 15. When the second sensor 249 senses quantity of the cleaning medium 15 stored on the first roller set 143 being insufficient, the second sensor 249 can generate a prompting signal for reminding a user to change the cleaning medium 15 or to stop operation of the clean device 10. For example, the second sensor 249 can sense thickness of the used cleaning medium 15, which means when the thickness of the used cleaning medium 15 is greater than a predetermined value, that is the unused cleaning medium 15 is insufficient, the prompting signal can be generated by the second sensor 249. Or the cleaning medium 15 can be marked a sign in advance, then the prompting signal can be generated when the sign of the cleaning medium 15 is sensed. The sensing methods are not limited to above-mentioned methods and are related to the actual demands. The third actuator 247 can be an air cylinder.

In addition, the clean device 10 further includes a control interface 26 for controlling the first actuator 18, the second actuator 20, and the third actuator 247. The control interface 26 includes a time relay 261 for controlling continuous closing motion of the positioning mechanism 12. When the user operates the clean device 10 by the control interface 26, the continuous closing motion of the positioning mechanism 12 can be controlled by the time relay 261 for preventing erroneous operation. The control interface 26 can be a manual switch, a pedal brake, or an automatic controller.

The operation of the clean device 10 includes following processes. For a start, the circuit board 13 is positioned on the positioning mechanism 12 and an end of the goldfinger 131 is put toward the wiping mechanism 16. Then, the control interface 26 is operated for controlling the clean device 10, so that the positioning mechanism 12 is driven by the first actuator 18 to position the circuit board 13 on the position between the two rollers 161 of the wiping mechanism 16. At this time, the continuous closing motion of the positioning mechanism 12 can be controlled by the time relay 261 for preventing erroneous operation.

When the first sensor 163 senses the circuit board 13 having been positioned on the predetermined position, the two rollers 161 of the wiping mechanism 16 can clamp the circuit board 13 in a predetermined pressure, such as a pressure of 0.5 Mpa. Then, the first actuator 18 can drive the first driving module 145 of the delivering mechanism 14 to output the cleaning medium 15 from the first roller set 143 to the two rollers 161 of the wiping mechanism 16, so that the cleaning medium 15 covering on the peripheral surfaces of the two rollers 161 can be used for cleaning the goldfinger 131 of the circuit board 13. The control interface 26 can be set to complete one time wiping when the two rollers 161 are rotated in a predetermined angles, which means the cleaning medium 15 is moved forward at a predetermined distance. Then, the control interface 26 can control the positioning mechanism 12 to withdraw the circuit board 13 from the wiping mechanism 16. For example, when the cleaning medium 15 is moved forward at 10 mm, the one time wiping is completed and the circuit board 13 can be loosened from the wiping mechanism 16 and withdrawn by the positioning mechanism 12.

After that, the used cleaning medium 15, which is output from the two rollers 161 of the wiping mechanism 16, can be conveyed to the second roller set 221 of the recycling mechanism 22 by way of clamping by the back pressure mechanism 24. The shaft support 245 of the back pressure mechanism 24 can be used for pressing the driving wheel 241, so that the driving wheel 241 and the following wheel 243 can clamp the cleaning medium 15 together so as to keep the single delivering direction of the cleaning medium 15 delivered from the delivering mechanism 14 to the recycling mechanism 22 and to prevent the cleaning medium 15 from moving backward.

Comparing to the prior art, the clean device of the present invention can reduce complexity of operation, so as to increase operational efficiency better than conventional artificial operation. In addition, the present invention can further utilize the positioning mechanism to position the circuit board and to keep the predetermined pressure on the cleaning medium so as to clean the goldfinger with better quality. Besides, the wiping mechanism of the present invention can apply the predetermined pressure on the circuit board stably so as to prevent the goldfinger from being broken. The clean device of the present invention can further decrease working hour of 25% off. For example, one operational time of the conventional artificial operation spends 12 seconds, and one operational time of the clean device of the present invention only spends 9 seconds. The present invention can work for any electronic products that include the goldfinger, and provides a preferred cleaning efficiency.

Those skilled in the art will readily observe that numerous modifications and alterations of the device and method may be made while retaining the teachings of the invention.

What is claimed is:

1. A clean device comprising:

a positioning mechanism for conveying a circuit board and for positioning the circuit board on a predetermined position;

a delivering mechanism for delivering a cleaning medium to the predetermined position, the delivering mechanism comprising:

a first roller set for storing the cleaning medium; and a first driving module connected to the first roller set for driving the first roller set so as to output the cleaning medium; and a wiping mechanism for wiping a goldfinger of the circuit board by utilizing the cleaning medium after the positioning mechanism positions the circuit board on the predetermined position.

2. The clean device of claim 1, wherein the wiping mechanism comprises two rollers for receiving the cleaning medium delivered from the delivering mechanism and for clamping the cleaning medium to clean the goldfinger of the circuit board.

3. The clean device of claim 2, wherein the cleaning medium covers on peripheral surfaces of the two rollers.

4. The clean device of claim 2, wherein each roller is made of silica gel, plastic, or metal material.

5. The clean device of claim 2, wherein the wiping mechanism further comprises a first sensor disposed between the two rollers for sensing a position of the circuit board.

6. The clean device of claim 1, wherein the first driving module is a belt.

7. The clean device of claim 1 further comprising:

a first actuator for driving the positioning mechanism and the delivering mechanism.

8. The clean device of claim 7, wherein the first actuator is an air cylinder.

9. The clean device of claim 7, further comprising:

a second actuator for driving the wiping mechanism.

10. The clean device of claim 9, wherein the second actuator is an air cylinder.

11. The clean device of claim 9, further comprising:

a recycling mechanism for receiving the cleaning medium delivered from the wiping mechanism, the recycling mechanism comprising:

a second roller set for receiving the cleaning medium;

a second driving module connected to the second roller set for driving the second roller set so as to receive the cleaning medium; and a power module for driving the second driving module.

12. The clean device of claim 11, wherein the second driving module is a belt.

13. The clean device of claim 11, further comprising:

a back pressure mechanism disposed between the wiping mechanism and the recycling mechanism, the back pressure mechanism comprising:

a driving wheel;

a following wheel for clamping the cleaning medium with the driving wheel;

a shaft support connected to the driving wheel for pressing the driving wheel so that the driving wheel and the following wheel clamp the cleaning medium together; and a third actuator connected to the shaft support for driving the shaft support.

14. The clean device of claim 13, wherein the back pressure mechanism further comprises a second sensor for sensing a status of the cleaning medium.

15. The clean device of claim 13, wherein the third actuator is an air cylinder.

16. The clean device of claim 13, further comprising:

a control interface for controlling the first actuator, the second actuator, and the third actuator.

17. The clean device of claim 16, wherein the control interface comprises a time relay for controlling continuous closing motion of the positioning mechanism.

18. The clean device of claim 16, wherein the control interface is a manual switch, a pedal brake, or an automatic controller.

19. The clean device of claim 1, wherein the cleaning medium is made of cloth.

* * * * *